US007666272B2

(12) United States Patent
Williams et al.

(10) Patent No.: US 7,666,272 B2
(45) Date of Patent: Feb. 23, 2010

(54) PAPER ARTICLES EXHIBITING WATER RESISTANCE AND METHOD FOR MAKING SAME

(75) Inventors: Richard C Williams, Loveland, OH (US); Peter M Froass, Mason, OH (US); Sandeep Kulkarni, Morrow, OH (US)

(73) Assignee: International Paper Company, Memphis, TN (US)

( * ) Notice: Subject to any disclaimer, the term of this patent is extended or adjusted under 35 U.S.C. 154(b) by 157 days.

(21) Appl. No.: 11/904,611

(22) Filed: Sep. 27, 2007

(65) Prior Publication Data

US 2008/0156449 A1 Jul. 3, 2008

Related U.S. Application Data

(63) Continuation of application No. 10/430,244, filed on May 6, 2003, now Pat. No. 7,279,071, which is a continuation-in-part of application No. 10/117,358, filed on Apr. 5, 2002, now Pat. No. 6,645,642.

(60) Provisional application No. 60/283,055, filed on Apr. 11, 2001, provisional application No. 60/283,677, filed on Apr. 12, 2001, provisional application No. 60/283,066, filed on Apr. 11, 2001.

(51) Int. Cl.
*D21F 11/00* (2006.01)

(52) U.S. Cl. ..... 162/135; 162/164.1; 162/164.4; 162/168.1; 162/172

(58) Field of Classification Search ..... 162/135, 162/164.1, 164.6, 168.1, 172; 564/509
See application file for complete search history.

(56) References Cited

U.S. PATENT DOCUMENTS

| | | | |
|---|---|---|---|
| 3,174,874 | A | 3/1965 | Winter et al. |
| 3,293,114 | A | 12/1966 | Kenaga et al. |
| 3,533,908 | A | 10/1970 | Hoogsteen |
| 3,556,934 | A | 1/1971 | Meyer |
| 4,040,900 | A | 8/1977 | Mazzarella et al. |
| 4,133,688 | A | 1/1979 | Sack |
| 4,179,546 | A | 12/1979 | Garner et al. |
| 4,279,794 | A | 7/1981 | Dumas |
| 4,444,847 | A | 4/1984 | Fujioka et al. |
| 4,448,807 | A | 5/1984 | Serlin |
| 4,483,889 | A | 11/1984 | Andersson |
| 5,017,416 | A | 5/1991 | Imperial et al. |
| 5,087,457 | A | 2/1992 | Bryant et al. |
| 5,125,996 | A | 6/1992 | Campbell et al. |
| 5,133,835 | A | 7/1992 | Goettmann et al. |
| 5,342,649 | A | 8/1994 | Sarokin |
| 5,415,923 | A | 5/1995 | Sarokin et al. |
| 5,514,429 | A | 5/1996 | Kamihgaraguchi et al. |
| 5,681,851 | A | 10/1997 | Lee et al. |
| 5,709,976 | A | 1/1998 | Malhotra |
| 5,938,825 | A | 8/1999 | Gaglani et al. |
| 5,985,076 | A | 11/1999 | Misuda et al. |
| 6,022,816 | A | 2/2000 | Dewar |
| 6,034,081 | A | 3/2000 | Whittemore et al. |
| 6,048,575 | A | 4/2000 | Altavilla |
| 6,087,457 | A | 7/2000 | Tsai |
| 6,183,814 | B1 | 2/2001 | Nangeroni et al. |
| 6,197,805 | B1 | 3/2001 | Smith |
| 6,210,767 | B1 | 4/2001 | Knauf |
| 6,221,798 | B1 | 4/2001 | Mahale et al. |
| 6,241,994 | B1 | 6/2001 | Lee et al. |
| 6,358,576 | B1 | 3/2002 | Adur et al. |
| 6,379,497 | B1 | 4/2002 | Sandstrom et al. |
| 6,645,642 | B2 | 11/2003 | Kulkarni et al. |
| 6,951,962 | B2 | 10/2005 | Bottorff |
| 2002/0040088 | A1 | 4/2002 | Buchholz et al. |
| 2002/0185239 | A1 | 12/2002 | Kimpimaki et al. |

FOREIGN PATENT DOCUMENTS

| | | | |
|---|---|---|---|
| DE | 142 217 | A | 1/1987 |
| EP | 0629741 | A1 | 6/1994 |
| EP | 0666368 | A3 | 7/1996 |
| GB | 786543 | | 10/1955 |
| GB | 903416 | | 11/1959 |
| GB | 1373788 | | 10/1971 |
| GB | 1533434 | | 3/1976 |
| GB | 2307487 | | 5/1997 |
| JP | 06-329834 | A2 | 11/1994 |
| JP | 10034791 | A2 | 7/1996 |
| WO | WO 00/44983 | A | 8/2000 |
| WO | WO 01/94512 | A1 | 5/2001 |
| WO | WO 02/084026 | A | 10/2002 |
| WO | WO 02/085539 | A | 10/2002 |

OTHER PUBLICATIONS

"Technology Review Series Triclosan and Its Impurities," by J. Menoutis, Ph.D, copyright 1998-2001 Quantex Laboratories (2 pgs.).

"Handbook for Pulp & Paper Technologies", 2nd Edition, G.A. Smook, Angus Wilde Publications (1992).

C.E. Farley and R. B. Wasser in The Sizing of Paper, Second Edition, edited by W.F. Reynolds, Tappi Press, 1989, pp. 51-62.

E. Strazdins in The Sizing of Paper, Second Edition, edited by W. F. Reynolds, Tappi Press, 1989, pp. 1-33.

*Primary Examiner*—Mark Halpern
(74) *Attorney, Agent, or Firm*—Thomas W. Barnes, III; Amy L. Miller

(57) ABSTRACT

This invention relates to a process for preparing sized paper and paperboard which incorporates in the paper and paperboard at the size press size a composition comprising one or more "hydrophobic polymers" wherein hydrophobic polymers, the amount of such polymers and the weight ratio of starch to such polymer in the composition are selected such that the paper and paper board exhibits a Cobb Value equal to or less than about 25 and to a sized paper or paperboard web formed by the process.

21 Claims, 2 Drawing Sheets

Fig. 1. Felt Side Cobb Size Test
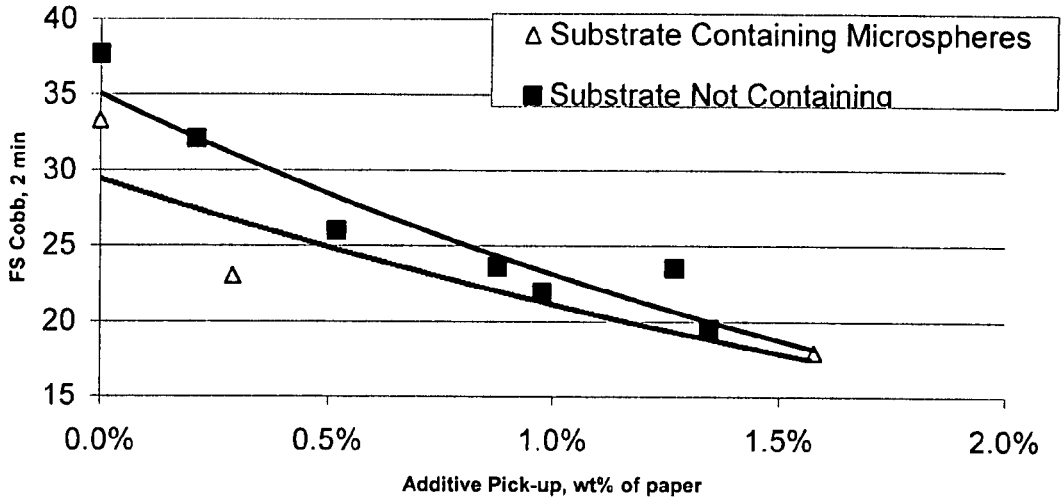
Fig. 2. Wire Side Cobb Size Test
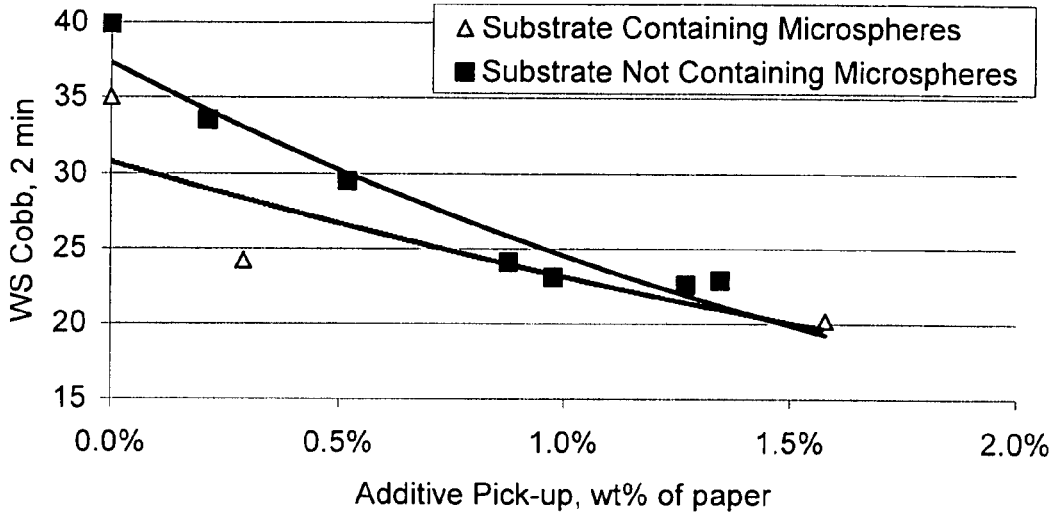

Fig. 3. Felt Side Contact Angle
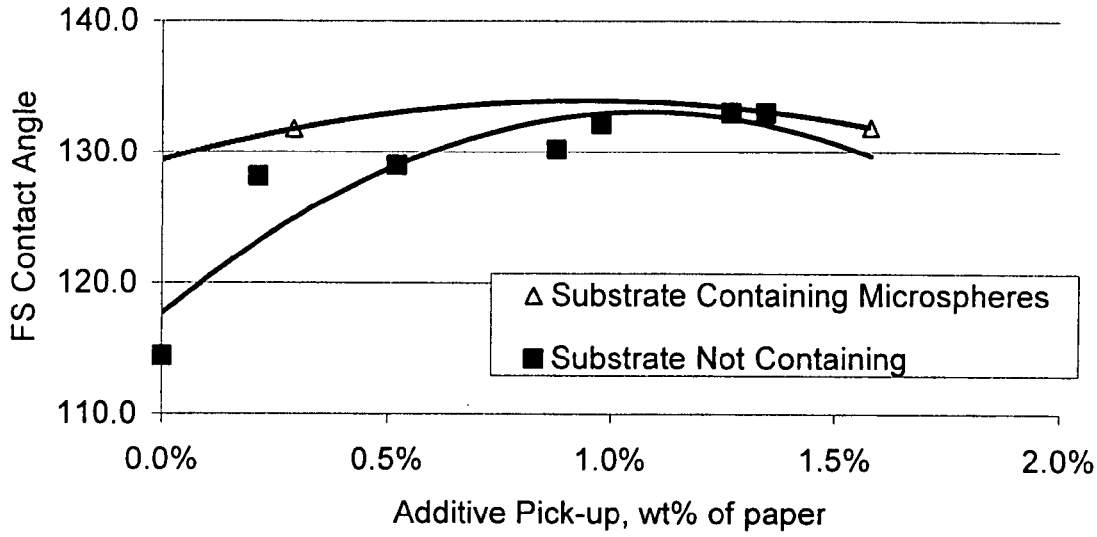
Fig. 4. Wire Side Contact Angle
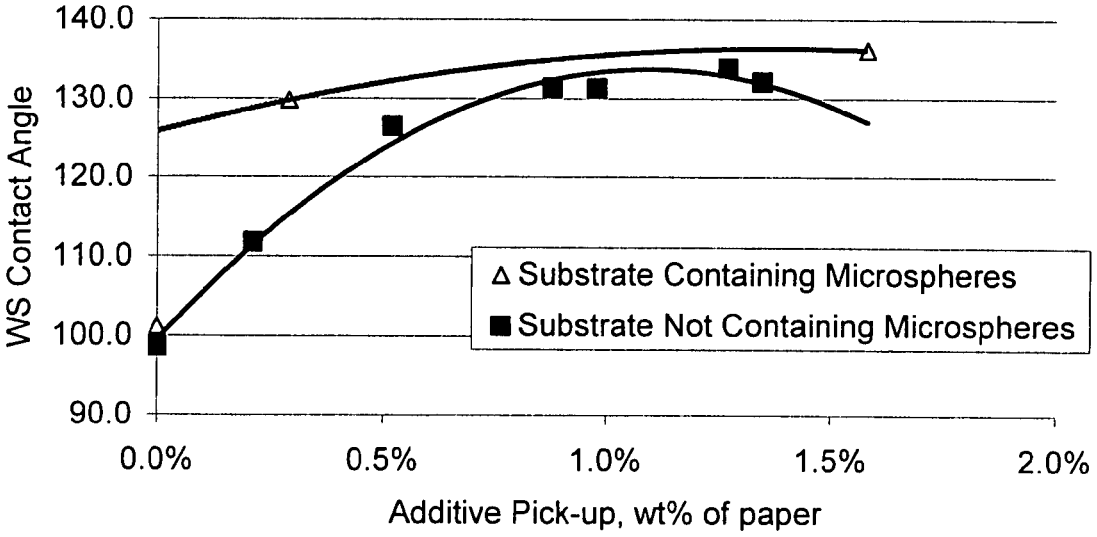

PAPER ARTICLES EXHIBITING WATER RESISTANCE AND METHOD FOR MAKING SAME

RELATED APPLICATIONS

This application claims the benefit of provisional application Ser. No. 60/283,055, filed Apr. 11, 2001, of provisional application Ser. No. 60/283677, filed Apr. 12, 2001, provisional application Ser. No. 60/283,066, filed Apr. 11, 2001, and of utility application Ser. No. 10/117,358 filed Apr. 5, 2002.

BACKGROUND

1. Field of the Invention

The invention relates to the papermaking art and, in particular, to the manufacture of paper and paperboard which exhibit improved water resistance properties. This invention also relates to articles of manufacture made from such products such as file folders, non-corrugated containers, and the like.

2. Background of the Invention

Heavy weight cellulosic paper and paperboard webs and products made from same such as file folders and paperboard file containers are often subject to liquid or water damage during routine handling and long term storage. If moisture or aqueous liquid are absorbed by the paper or paperboard materials, the materials may become soggy, warped and/or weakened thereby reducing their usefulness and potentially allowing the liquids to contact and damage documents which may be stored in containers made with the paper or paperboard materials.

Surface sizing, i.e., the addition of sizing agents to the surface of a paper sheet that has been at least partially dried, is widely practiced in the paper industry, particularly for printing grades to improved water holdout (sizing). The most widely used surface sizing agent is starch. However, starch sizing alone has not been effective in providing water resistance to paper and paperboard products.

Accordingly, there exists a need for improved cellulose-based products, and in particular relatively heavy weight paper and paperboard products, which exhibit improved resistance to water and to a process for the manufacture of such water resistant cellulose-based products.

SUMMARY OF THE INVENTION

One aspect of this invention relates to a process for preparing sized paper and paperboard which incorporates in the paper and paperboard at the size press size a composition comprising one or more "hydrophobic polymers" either alone or in combination with one or more starches wherein hydrophobic polymers, the amount of such polymers and the weight ratio of said polymers and said starches are selected such that the paper and paper board web exhibits a Cobb value equal to or less than about 25 as determined by the Cobb Test described herein below and preferably has a contact angle equal to or greater than about 128° as determined by the contact angle test described herein below.

Another aspect of this invention relates to the sized paper or paperboard web formed by the method of this invention. The sized paper or paperboard web of this invention and products made from such web exhibits one or more beneficial properties such as resistance to water as determined by the "Cobb Test" and preferably by the "Contact Angle Test". The web and products of the invention more preferably exhibit acceptable writability and are repulpable.

BRIEF DESCRIPTION OF THE DRAWINGS

The above and other aspects and advantages of the invention will now be further described in conjunction with the accompanying drawings in which:

FIG. 1 is a graph of Cobb Value versus the amount of hydrophobic material picked up by the felt side of the paper.

FIG. 2 is a graph of Cobb Value versus the amount of hydrophobic material picked up by the wire side of the paper.

FIG. 3 is a graph of Contact Angle versus the amount of hydrophobic material picked up by the felt side of the paper.

FIG. 4 is a graph of Contact Angle versus the amount of hydrophobic material picked up by the wire side of the paper.

DETAILED DESCRIPTION OF THE INVENTION

In the process of this invention, a paper or paperboard web is treated at the size press with a sizing composition comprising at least one hydrophobic polymer in the absence of substantial absence of starch or in combination with one or more starches. The presence of the hydrophobic polymer in the size composition is critical for the advantages of this invention. As used herein, a "hydrophobic polymer' is a homopolymer, copolymer or terpolymer" selected from the group consisting of styrene acrylic emulsions (SAE), styrene acrylic Acid (SAA), styrene maleic anhydride (SMA), alkylated melamines wherein the alkyl moiety is branched or linear and has at least about 7 carbon atoms, paraffin wax, polyurethanes, modified starch (hydrophobic starches), polyethylene, polymethylmetharcylate dispersion, alkyl ketene dimer, alkenyl ketene dimer, dispersed rosin and combination thereof. More preferred hydrophobic polymers are paraffin wax, alkylated melamines and most preferred are alkylated melamines wherein the alkyl moiety is linear, more preferably where the alkyl moiety is linear and has at least 9 carbon atoms, and most preferably where the alkyl moiety is linear and has at least about 13 carbon atoms as for example a stearylated melamine, laurlated melamine, myristalated melamine, palmitlated melamine and olelated melamine and a combination of paraffin wax and an alkylated melamine.

Useful hydrophobic polymers can be prepared by known techniques or obtained from commercial sources. These sources and techniques are well known in the art and will not be described in any great detail.

The amount of the hydrophobic polymers in the size composition is selected such that the paper and paper board resulting from the process exhibits a Cobb Value equal to or less than about 25 as determined by the Cobb Test described herein below and preferably exhibits a contact angle equal to or greater than about 128° as determined by the contact angle test described herein below. Preferably, the amount is such that the paper and paper board resulting from the process exhibits a Cobb Value equal to or less than about 23 and a contact angle equal to or greater than about 130°, more preferably the amount is such that the paper and paper board resulting from the process exhibits a Cobb Value equal to or less than about 21 and a contact angle equal to or greater than about 132° and most preferably the amount is such that the paper and paper board resulting from the process exhibits a Cobb Value equal to or less than about 20 and a contact angle equal to or greater than about 133°. It is believed that these Cobb Values, and preferably the desired writability and contact angle values, can be obtained where the amount of hydrophobic polymer in the size composition is such that the amount of such polymer picked up by the paper and paper board is preferably at least about 0.4 wt %, more preferably at least about 0.5 wt % and most preferably at least about 0.9 wt % based on the total weight of the paper or paperboard, and in the embodiments of choice from about 1.3 to about 3.0 wt %t The size composition may optionally include one or more starches. The amount of starch employed should not be such that the paper and paper board resulting from the process exhibits a Cobb Value equal to or less than about 25 and preferably exhibits a contact angle equal to or greater than about 128°. In the preferred embodiments of the invention, the amount of starch employed in the size composition is such that the weight ratio of starch to hydrophobic polymer picked up by the paper or paperboard is less than about 3 to about 1. In the more preferred embodiments of the invention, the amount of starch employed in the size composition is such that the weight ratio of starch to hydrophobic polymer picked up by the paper or paperboard is less than about 2 to about 1. In the most preferred embodiments of the invention, the amount of starch employed in the size composition is such that the weight ratio of starch to hydrophobic polymer picked up by the paper or paperboard is less than about 1 to about 1 and best if less than about 0.5 to about 1. In embodiments of choice, no or substantially no starch is employed in the size composition and no or substantially no starch is picked up by the paper or paperboard web.

The starch may be of any type, including but not limited to oxidized, ethylated, cationic and pearl, and is preferably used in aqueous solution. Illustrative of useful starches for the practice of this preferred embodiment of the invention are naturally occurring carbohydrates synthesized in corn, tapioca, potato and other plants by polymerization of dextrose units. All such starches and modified forms thereof such as starch acetates, starch esters, starch ethers, starch phosphates, starch xanthates, anionic starches, cationic starches and the like which can be derived by reacting the starch with a suitable chemical or enzymatic reagent can be used in the practice of this invention.

Useful starches may be prepared by known techniques or obtained from commercial sources. For example, the suitable starches include PG-280 from Penford Products, SLS-280 from St. Lawrence Starch, the cationic starch CatoSize 270 from National Starch and the hydroxypropyl No. 02382 from Poly Sciences, Inc.

Preferred starches for use in the practice of this invention are modified starches. More preferred starches are cationic modified or non-ionic starches such as CatoSize 270 and KoFilm 280 (all from National Starch) and chemically modified starches such as PG-280 ethylated starches and AP Pearl starches. More preferred starches for use in the practice of this invention are cationic starches and chemically modified starches.

In addition to the starch, small amounts of other additives may be present as well in the size composition. These include without limitation dispersants, fluorescent dyes, surfactants, deforming agents, preservatives, pigments, binders, pH control agents, coating releasing agents, optical brighteners, defoamers and the like.

Methods and apparatuses for treating a dried web of paper or paperboard with a sizing composition are well known in the paper and paperboard art. See for example "Handbook For Pulp & Paper Technologies", $2^{nd}$ Edition, G. A. Smook, Angus Wilde Publications (1992) and references cited therein. Any conventional size treatment method and apparatus can be used. Consequently, these methods and apparatuses will not be described herein in any great detail. By way of example, the size composition may be applied from a size press that can be any type of coating or spraying equipment, but most commonly is a puddle, gate roller or metered blade type of size press.

Any conventional paper or paperboard web can be used in the practice of this invention. Such webs and methods and apparatus for their manufacture are well known in the art. See for example G. A. Smook referenced above and references cited therein. For example, the paper and paperboard web can made from pulp fibers derived from hardwood trees, softwood trees, or a combination of hardwood and softwood trees prepared for use in a papermaking furnish by any known suitable digestion, refining, and bleaching operations as for example known mechanical, thermomechanical, chemical and semichemical, etc., pulping and other well known pulping processes. In certain embodiments, at least a portion of the pulp fibers may be provided from non-woody herbaceous plants including, but not limited to, kenaf, hemp, jute, flax, sisal, or abaca although legal restrictions and other considerations may make the utilization of hemp and other fiber sources impractical or impossible. Either bleached or unbleached pulp fiber may be utilized in the process of this invention. Recycled pulp fibers are also suitable for use. In a preferred embodiment, the cellulosic fibers in the paper include from about 30% to about 100% by weight dry basis softwood fibers and from about 70% to about 0% by weight dry basis hardwood fibers. In the preferred embodiments of the invention, in addition to pulp fibers and optional additives, the paper or paperboard web also includes dispersed within the fibers and any other components expanded microspheres. Experimentation has shown that the combination of microspheres and hydrophobic polymer provides a paper or paperboard web and product made there from exhibiting even greater improvements in water resistance than the starch and hydrophobic polymer alone.

Expanded and expandable microspheres are well known in the art. See for example Expandable microspheres are described in co pending applications Ser. No. 09/770,340 filed Jan. 26, 2001 and Ser. No. 10/121,301, filed Apr. 11, 2002 and U.S. Pat. Nos. 3,556,934, 5,514,429, 5,125,996, 3,533,908, 3,293,114, 4,483,889, and 4,133,688; and UK Patent Application 2307487, the contents of which are incorporated by reference. All such microspheres can be used in the practice of this invention.

Suitable microspheres include synthetic resinous particles having a generally spherical liquid-containing center. The resinous particles may be made from methyl methacrylate, ethyl methacrylate, ortho-chlorostyrene, polyortho-chlorostyrene, polyvinylbenzyl chloride, acrylonitrile, vinylidene chloride, para-tert-butyl styrene, vinyl acetate, butyl acrylate, styrene, methacrylic acid, vinylbenzyl chloride and combinations of two or more of the foregoing. Preferred resinous particles comprise a polymer containing from about 65 to about 90 percent by weight vinylidene chloride, preferably from about 65 to about 75 percent by weight vinylidene chloride, and from about 35 to about 10 percent by weight acrylonitrile, preferably from about 25 to about 35 percent by weight acrylonitrile.

The amount of microspheres may vary widely and depends on the desired expanded microsphere volume in the final paper product. Preferably the paper includes from about 0.5 to about 5.0 wt % expanded microspheres and more preferably from about 1.0 to about 2.0 wt % by dry weight of the paper or paperboard web.

The web may also include other conventional additives such as, for example, starch, mineral fillers, sizing agents, retention aids, and strengthening polymers. Among the fillers that may be used are organic and inorganic pigments such as, by way of example, polymeric particles such as polystyrene latexes and polymethylmethacrylate, and minerals such as calcium carbonate, kaolin, and talc. Other conventional additives include, but are not restricted to, wet strength resins, internal sizes, dry strength resins, alum, fillers, pigments and dyes. For obtaining the highest levels of surface sizing in the processes of this invention, it is preferred that the sheet be internally sized, that is, that sizing agents be added to the pulp suspension before it is converted to a paper sheet. Internal sizing helps prevent the surface size from soaking into the sheet, thus allowing it to remain on the surface where it has maximum effectiveness. The internal sizing agents encompass any of those commonly used at the wet end of a fine paper machine. These include rosin sizes, ketene dimers and multimers, and alkenylsuccinic anhydrides. The internal sizes are generally used at levels of from about 0.05 wt. % to about 0.25 wt. % based on the weight of the dry paper sheet. Methods and materials utilized for internal sizing with rosin are discussed by E. Strazdins in The Sizing of Paper, Second Edition, edited by W. F. Reynolds, Tappi Press, 1989, pages 1-33. Suitable ketene dimers for internal sizing are disclosed in U.S. Pat. No. 4,279,794, which is incorporated by reference in its entirety, and in United Kingdom Patent Nos. 786,543; 903,416; 1,373,788 and 1,533,434, and in European Patent Application Publication No. 0666368 A3. Ketene dimers are commercially available, as Aquapel.RTM. and Precis.RTM. sizing agents from Hercules Incorporated, Wilmington, Del. Ketene multimers for use in internal sizes are described in: European Patent Application Publication No. 0629741A1, corresponding to U.S. patent application Ser. No. 08/254,813, filed Jun. 6, 1994; European Patent Application Publication No. 0666368A3, corresponding to U.S. patent application Ser. No. 08/192,570, filed Feb. 7, 1994; and U.S. patent application Ser. No. 08/601,113, filed Feb. 16, 1996. Alkenylsuccinic anhydrides for internal sizing are disclosed in U.S. Pat. No. 4,040,900, which in incorporated herein by reference in its entirety, and by C. E. Farley and R. B. Wasser in The Sizing of Paper, Second Edition, edited by W. F. Reynolds, Tappi Press, 1989, pages 51-62. A variety of alkenylsuccinic anhydrides are commercially available from Albemarle Corporation, Baton Rouge, La.

The density, basis weight and caliper of the web of this invention may vary widely and conventional basis weights, densities and calipers may be employed depending on the paper-based product formed from the web. Paper or paperboard of invention preferably have a final caliper, after calendering of the paper, and any nipping or pressing such as may be associated with subsequent coating of from about 2 mils to about 30 mils although the caliper can be outside of this range if desired. More preferably the caliper is from about 4 mils to about 20 mils, and most preferably from about 7 mils to about 17 mils. Papers of the invention preferably exhibit basis weights of from about 17 lb/3000 $ft^2$ to about 300 lb/3000 $ft^2$, although web basis weight can be outside of this range if desired. More preferably the basis weight is from about 30 lb/3000 $ft^2$ to about 200 lb/3000 $ft^2$, and most preferably from about 35 lb/3000 $ft^2$ to about 150 lb/3000 $ft^2$. The final density of the papers, that is, the basis weight divided by the caliper, is preferably from about 6 lb/3000 $ft^2$/mil to about 14 lb/300 $ft^2$/mil although web densities can be outside of this range if desired. More preferably the web density is from about 7 lb/3000 $ft^2$/mil to about 13 lb/3000 $ft^2$/mil and most preferably from about 9 lb/3000 $ft^2$/mil to about 12 lb/3000 $ft^2$/mil. Thus, in the preferred embodiments of the invention the paper or paperboard has a relatively larger caliper in relation to its weight compared to conventional papers. In these preferred embodiments of the invention, the reduction in basis weight versus caliper is believed to be attributable at least in part to the large number of tiny voids in the paper associated with the expanded microspheres interspersed in the fibers with the microspheres causing, especially during the expansion process, a significant increase in the void volume in the material. In addition, the paper after drying operations is calendered sufficient to achieve the final desired calipers discussed herein along with any desired surface conditioning of the web associated with the calendering operation. The impartation of a significantly increased void volume along with a relatively high caliper also has the effect of reducing the density of the paper while retaining good stiffness and other properties important for use as stock for file folders and the like.

Preferably the process comprises: a) providing an aqueous pulp suspension; b) sheeting and drying the aqueous pulp suspension to obtain dried paper or paperboard web; c) treating the dried paper or paper or paperboard web by applying to at least one surface of the web a size composition containing one or more hydrophobic polymers and starch to form a treated paper or paperboard web; and d) drying the paper to obtain sized paper or paperboard web.

In step a) of the preferred embodiment of this invention, an aqueous pulp suspension is provided. Methods of forming aqueous pulp suspensions are well known in the paper and paperboard art and will not be described in any great detail. See for example G. A. Smook referenced above and references cited therein. Any conventional aqueous pulp suspensions method can be used. The cellulosic fibrous component of the furnish is suitably of the chemically pulped variety, such as a bleached kraft pulp, although the invention is not believed to be limited to kraft pulps, and may also be used with good effect with other chemical pulps such as sulfite pulps, mechanical pulps such as ground wood pulps, and other pulp varieties and mixtures thereof such as chemical-mechanical and thermo-mechanical pulps.

While not essential to the invention, the pulp is preferably bleached to remove lignins and to achieve a desired pulp brightness according to one or more bleaching treatments known in the art including, for example, elemental chlorine-based bleaching sequences, chlorine dioxide-based bleaching sequences chlorine-free bleaching sequences, elemental chlorine-free bleaching sequences, and combinations or variations of stages of any of the foregoing and other bleaching related sequences and stages. After bleaching is completed and the pulp is washed and screened, it is generally subjected to one or more refining steps. Thereafter, the refined pulp is passed to a blend chest where it is mixed with various additives and fillers typically incorporated into a papermaking furnish as well as other pulps such as unbleached pulps and/or recycled or post-consumer pulps. The additives may include so-called "internal sizing" agents used primarily to increase the contact angle of polar liquids contacting the surface of the paper such as alkenyl succinic anhydride (ASA), alkyl ketene dimer (AKD), and rosin sizes. Retention aids may also be added at this stage. Cationic retention aids are preferred; however, anionic aids may also be employed in the furnish.

In addition, and prior to providing the furnish to the headbox of a papermaking machine, polymeric microspheres are preferably added to the pulp furnish mixture if desired as a component of the paper or paperboard web. The microspheres may be preexpanded or in substantially their final dimension prior to inclusion in the furnish mixture. The microspheres preferably are in the subsist in an "unexpanded" state in the original papermaking furnish from which the web is derived and, upon heating during the paper or paper board manufacturing process, undergo expansion in diameter such that in final sized paper paperboard web they are in an "expanded" state. It will be appreciated that this expansion has the effect of enabling an increased caliper and reduced density in the final paper product. It is also within the scope of the invention to include mixtures of expandable and already-expanded microspheres (or microspheres that are already substantially in their final dimensional state) in the papermaking furnish so that a portion of the microspheres will expand to a substantial degree in drying operations while the balance will remain in substantially the same overall dimensions during drying. The degree of expansion may vary widely. Preferably the degree of expansion is at least about 200% based on the volume of the unexpanded microspheres, more preferably at least about 300% and more preferably from about 300 to about 600% on the aforementioned basis. In their original unexpanded state, the center of the expandable microspheres may include a volatile fluid foaming agent to promote and maintain the desired volumetric expansion. Preferably, the agent is not a solvent for the polymer resin. A particularly preferred foaming agent is low molecular linear or branch alkane or alkene as for example isobutane, which may be present in an amount sufficient for the desired degree of expansion. In the preferred embodiments amount may range from about 10 to about 25 percent by weight of the total weight of the resinous particles. Suitable expandable microspheres can be prepared using known techniques or commercially as for example suitable microspheres are available from Akzo Nobel of Marietta, Ga. under the tradename EXPANCEL.

In step (b) of the process of this invention, the pulp suspension of step (a) is sheeted and dried to obtain dried paper or paperboard web. Methods and apparatuses for sheeting and drying a pulp suspension are well known in the paper and paperboard art. See for example G. A. Smook referenced above and references cited therein. Any conventional sheeting and drying method can be used. Consequently, these methods will not be described herein in any great detail. By way of example, the aqueous paper making stock furnish containing pulp, and other additives is deposited from the head box of a suitable paper making machine into a single or multi-ply web on a papermaking machine such as a Fourdrinier machine or any other suitable papermaking machine known in the art, as well as those which may become known in the future. For example, a so-called "slice" of furnish consisting of a relatively low consistency aqueous slurry of the pulp fibers along with the microspheres and various additives and fillers dispersed therein is ejected from a headbox onto a porous endless moving forming sheet or wire where the liquid is dewatered by gradually drained through small openings in the wire by vacuum in the forming section until a mat of pulp fibers and the other materials is formed on the wire. The dewatered wet mat or web is transferred from the forming section to the press section on specially constructed felts through a series of roll press nips that removes water and consolidates the wet web of paper. The web is then passed to an initial dryer section to remove most of the retained moisture and further consolidate the fibers in the web. The heat of the drying section also promotes expansion of unexpanded microspheres that may be contained in the web.

In step (c) of the process of this invention, the dried paper or paper or paperboard web is treated by applying to at least one surface of the web a size composition comprising one or more hydrophobic polymers. Methods and apparatuses for treating a dried web of paper or paperboard with a sizing composition are well known in the paper and paperboard art. See for example, G. A. Smook referenced above and references cited therein. Other additives such as starch, pigments, and other additives may be applied to the web and incorporated therein by the action of the press if desired as described above in more detail.

In step (d) of the preferred embodiment of the process of this invention, the paper or paperboard web is dried after treatment with the size composition. Methods and apparatuses for drying paper or paperboard webs treated with a sizing composition are well known in the paper and paperboard art. See for example G. A. Smook referenced above and references cited therein. Any conventional drying method and apparatus can be used. Consequently, these methods and apparatuses will not be described herein in any great detail. After drying, the paper may be subjected to one or more post drying steps as for example those described in G. A. Smook referenced above and references cited therein. For example, the paper or paperboard web may be coated and/or calendered to achieve the desired final caliper as discussed above to improve the smoothness and other properties of the web. The calendering may be accomplished by steel-steel calendaring at nip pressures sufficient to provide a desired caliper. It will be appreciated that the ultimate caliper of the paper ply will be largely determined by the selection of the nip pressure An important property of the webs made according to the invention is their watershedability or resistance to wetting by aqueous fluids. Surface sized paper and paperboard webs produced by the process of this invention have water resistance properties that are substantially improved over those of paper and paperboard webs that is the same except that they have not been surface sized with a combination of starch and hydrophobic polymer in accordance with this invention. The resistance of the web to wetting by aqueous fluids can be determined by the Cobb Sizing Test, according to ASTM D-3285 (TAPPI T-441). Conventional, sized webs used for file folders have a five-minute water absorption in the range of from about 50 to 70 grams per square meter of paper tested. The web 10 containing holdout layer 12 and print receptive layer 14 preferably has a five minute water absorption in the range of from about 30 to about 40 grams per square meter. A tester for performing the Cobb sizing test consists of a hollow metal cylinder or ring (100, 25 or 10 $cm^2$ inside area). A metal base plate with a clamping device is used to hold the ring against the sample of paper to be tested and a neoprene mat. Neoprene gaskets may be used to seal the cylinder against the web when the test sample is uneven. An important component of the test apparatus is a solid stainless steel roller having a smooth face about 20 cm wide and weighing about 10 kg. Also used for the test is a 100 mL graduated cylinder, a balance with sensitivity of 0.01 grams or better, blotting paper, and a timer or stopwatch. A sample of paper or paperboard material to be tested is cut approximately 12.5×12.5 cm square from the coated web. The sample is weighed and placed on the neoprene mat. The cylinder is clamped upon the sample by locking a crossbar in place and tightening two knobs. If sample material is textured, a gasket is placed between the sample and cylinder, carefully aligning the inner edges of each. The test liquid, in this case preferably water is poured into the test cylinder. The amount of test liquid is preferably 100 mL for 100 square centimeter cylinder. Proportionately less liquid is used for smaller cylinders. After pouring the liquid, the timer is started to provide a five-minute test. Longer and shorter test periods may be provided. At fifteen seconds before the expiration of the predetermined test period, the liquid is quickly poured from the cylinder, using care in not dropping any liquid on the untreated (outside) portion of the test specimen. The cylinder is removed from the sample and the sample is placed with wetted side up on a sheet of blotting paper. At exactly the end of the predetermined test period, a second sheet of blotting paper is placed on top of the sample to remove the surplus liquid by moving the hand roller once forward and once backward over the sample and blotting paper. Care should be taken not to exert downward force on the roller. The specimen is then folded after removing it from between the blotter sheets and re-weighed to the nearest 0.01 gram. The initial weight of the web is subtracted from the final weight of the sample and the gain in weight in grams is multiplied by 100 for a 100 $cm^2$ cylinder to obtain the weight of liquid absorbed in grams per square meter. The paper or paperboard of this invention exhibits a Cobb Value equal to or less than about 25, preferably equal to or less than about 23, more preferably equal to or less than about 21 and most preferably equal to or less than about 20.

In the preferred embodiments of the invention, the resistance of the web to wetting by aqueous fluids can also be determined by Contact Angle Test. Contact angle measurements are performed on narrow strips (¼-⅓ inch) of paper cut diagonally across the sample. A water droplet (or other liquid) is deposited onto the surface of the paper. A video camera records the droplet over a period of ca. 4.5 sec. Frames are captured at 0.1 second intervals. Contact angles are then calculated using image analysis on the video images. The measurements are conducted at room temperature. Typically, six droplets are analyzed per sample. The instrument used is a First Ten Angstroms, FTA, Instrument. The contact angle is equal to or greater than about 128°, preferably equal to or less than about 130°, more preferably equal to or less than about 132° and most preferably equal to or less than about 133°.

The paper and paperboard web of this invention can be used in the manufacture of a wide range of paper-based products where water resistance is desired using conventional techniques. For example, paper and paperboard webs formed according to the invention may be utilized in a variety of office or clerical applications. The web is preferably used for making file folders, manila folders, flap folders such as Bristol base paper, and other substantially inflexible paperboard webs for use in office environments, including, but not limited to paperboard containers for such folders, and the like. The manufacture of such folders from paper webs is well known to those in the paper converting arts and consists in general of cutting appropriately sized and shaped blanks from the paper web, typically by "reverse" die cutting, and then folding the blanks into the appropriate folder shape followed by stacking and packaging steps. The blanks may also be scored beforehand if desired to facilitate folding. The scoring, cutting, folding, stacking, and packaging operations are ordinarily carried out using automated machinery well-known to those of ordinary skill on a substantially continuous basis from rolls of the web material fed to the machinery from an unwind stand.

The following non-limiting examples illustrate various additional aspects of the invention. Unless otherwise indicated, temperatures are in degrees Celsius, percentages are by weight and the percent of any pulp additive or moisture is based on the oven-dry weight of the total amount of material.

EXAMPLE I

A series of paperboard samples at a basis weight of 124 lb/3000 $ft^2$ was prepared from a combination of 65% hard wood and 35% soft wood pulps. The paper was sized internally with ASA size and contained ground calcium carbonate as filler. The paper was dried before the size press to about 3% moisture. A size solution containing an ethylated starch, to which varying amounts of a hydrophobic polymer was added was used for application at the puddle size press on the paper machine and is driven into the sheet running through the size press nips. The pick-up of starch and additive were calculated using the starch: additive ratio and the amount of wet pickup measured at the size press during manufacture. The paperboard samples are described in more detail in Table I.

TABLE I

| Substrate | (1)Hydrophobic Polymer Pick-Up, wt % | (2)Starch Pick-Up, wt % | (3)Expandable Microspheres wt % | Size Press Solids, wt % | Starch: Additive Ratio |
|---|---|---|---|---|---|
| 1 | 0.00% | 2.2% | 0% | 11% | Starch only |
| 2 | 0.21% | 1.9% | 0% | 11% | 9:1 |
| 3 | 0.52% | 1.6% | 0% | 11% | 3:1 |
| 4 | 0.88% | 1.3% | 0% | 11% | 1.5:1 |
| 5 | 0.98% | 1.0% | 0% | 11% | 1:1 |
| 6 | 1.35% | 0.6% | 0% | 11% | 0.42:1 |
| 7 | 1.27% | 1.3% | 0% | 15% | 1:1 |
| 8 | n.d. | 0.0% | 2% | 11% | Starch Only |
| 9 | 0.29% | 2.6% | 2% | 11% | 9:1 |
| 10 | n.d. | n.d. | 2% | 11% | 3:1 |
| 11 | n.d. | n.d. | 2% | 11% | 1.5:1 |
| 12 | n.d. | n.d. | 2% | 11% | 1:1 |
| 13 | 1.58% | 0.7% | 2% | 11% | 0.42:1 |

The terms identified by superscripts are defined as follows:
(1)"Hydrophobic Polymer" is a stearylated melamine/paraffin wax obtained commercially from RohmNova under the tradename Sequapel ® 414.
(2)"Starch" is an ethylated starch obtained commercially from Penford under the tradename Penford 270.
(3)"Microspheres" is a expandable microsphere obtained commercially from Expancel Inc. under the tradename "Expancel".

EXAMPLE II

The sample paperboards of Example I were evaluated to determine water resistance. The evaluation test used where the Cobb Test and the Contact Angle Test described above. The samples were also evaluated subjectively using the following scale:

(1) Excellent (A):

Water beads like water on a waxed surface and then when the paper is shaken off the water pretty much goes away. There could be some small remaining beads that need to be wiped off. There should also be no look of water penetrating the paper sheet over a 20 second period. A ballpoint pen or a pencil can write on the paper with minimal to no streaking.

(2) Good (B):

Water beads on the paper. When the paper is shaken off the beads that remain may be slightly larger than the excellent and you may also get some slight streaking of the water. Over a 20 second period you may see some cockle to the paper where water has just started to penetrate the sheet. You must be able to write on the sheet with a ballpoint pen or a pencil with minimal to no streaking.

(3) Poor (C):

Water does not bead and when the water is poured off the sheet it leaves behind evident streaks. Over a 20 second period you may see some increased cockle and water penetration into the paper.

The results are set forth in the figures and the following Table II.

TABLE II

| Substrate | 2 minute Cobb Size Test, Felt Side | 2 minute Cobb Size Test, Wire Side | Felt Side Contact Angle | Wire Side Contact Angle | 'Watershed-ability' |
|---|---|---|---|---|---|
| 1 | 37.7 | 39.9 | 114.4 | 98.6 | C |
| 2 | 32.1 | 33.5 | 128.1 | 111.7 | C |
| 3 | 26.0 | 29.5 | 128.9 | 126.4 | C |
| 4 | 23.6 | 24.1 | 130.2 | 131.4 | B |
| 5 | 21.9 | 23.1 | 132.2 | 131.3 | A |
| 6 | 19.5 | 22.9 | 133.0 | 132.1 | A |
| 7 | 23.5 | 22.6 | 133.0 | 133.9 | A |
| 8 | 33.3 | 35 | 114.6 | 101.2 | C |
| 9 | 23.0 | 24.2 | 131.7 | 129.8 | C |
| 10 | 20.6 | 21.6 | 134.5 | 134.2 | B |

TABLE II-continued

| Substrate | 2 minute Cobb Size Test, Felt Side | 2 minute Cobb Size Test, Wire Side | Felt Side Contact Angle | Wire Side Contact Angle | 'Watershed-ability' |
|---|---|---|---|---|---|
| 11 | 23.0 | 24.2 | 135.0 | 133.4 | A |
| 12 | 21.1 | 21.1 | 133.5 | 134.5 | A |
| 13 | 17.9 | 20.2 | 131.9 | 136.1 | A |

EXAMPLE III

Using the procedures of Examples I additional substrates were prepared. Process and product conditions are set forth in the following Table III.

TABLE III

| Substrate No. | Internal Sizing lb/Ton | Starch | Starch:\ Additive Wt Ratio | S.P. Solids | Pickup lb/Tons | Additives | Additive Pickup, % by wt Web | (3)Expandable Microspheres wt % |
|---|---|---|---|---|---|---|---|---|
| 1 | 1.5 | Yes | 1:0 | 8 | 37 | No | 0.00% | 0 |
| 1B | 1.5 | Yes | 1:0 | 12 | 62 | No | 0.00% | 0 |
| 2 | 3 | Yes | 1:0 | 12 | 64.4 | No | 0.00% | 0 |
| 3 | 4.5 | Yes | 1:0 | 12 | 50.8 | No | 0.00% | 0 |
| 4 | 4.5 | Yes | 2.3:1 | 8 | 32 | (8)Additive 1 | 0.48% | 0 |
| 4B | 4.5 | Yes | 2:1 | 8 | 33.7 | (8)Additive 1 | 0.56% | 0 |
| 4C | 4.5 | Yes | 1:1 | 8 | 34.3 | (8)Additive 1 | 0.86% | 0 |
| 5 | 4.5 | Yes | 2:1 | 8 | 32.4 | (7)Additive 2 | 0.53% | 0 |
| 5B | 4.5 | Yes | 1:1 | 8 | 35.2 | (4)Additive 3 | 0.88% | 0 |
| 6 | 4.5 | Yes | 2:1 | 8 | 31.1 | (4)Additive 3 | 0.51% | 0 |
| 6B | 4.5 | Yes | 1:1 | 8 | 31 | (4)Additive 3 | 0.78% | 0 |
| 9 | 4.5 | Yes | 2:1 | 8 | 33.8 | (5)Additive 5 | 0.56% | 0 |
| 9B | 4.5 | Yes | 1:1 | 8 | 33.3 | (5)Additive 5 | 0.83% | 0 |
| 10 | 4.5 | No | 0:1 | 6 | 9.3 | (1)Additive 4, 6% Solids - | 0.47% | 0 |
| 10B | 4.5 | No | 0:1 | 6 | 12.4 | (1)Additive 4, 6% Solids - | 0.62% | 0 |
| 11 | 4.5 | Yes | 2:1 | 8 | 31.3 | (1)Additive 4 | 0.52% | 0 |
| 11B | 4.5 | Yes | 1:1 | 8 | 33.7 | (1)Additive 4 | 0.84% | 0 |
| 12 | 4.5 | Yes | 10:1 | 8 | 31.2 | (9)Additive 9 | 0.14% | 0 |
| 12B | 4.5 | Yes | 1:1 | 8 | 31.8 | (9)Additive 9 | 0.80% | 0 |
| 12C | 4.5 | Yes | 10:1 | 8 | 31.5 | (6)Additive 6 | 0.14% | 0 |
| 13 | 4.5 | Yes | 2:1 | 8 | 29.5 | (1)Additive 4 | 0.49% | 0 |
| 13B | 1.5 | Yes | 2:1 | 8 | 35 | (1)Additive 4 | 0.58% | 0 |
| 13C | 1.5 | Yes | 1:1 | 8 | 34.6 | (1)Additive 4 | 0.87% | 0 |
| 14 | 1.5 | Yes | 1:1 | 8 | 36.6 | (5)Additive 5 | 0.92% | 0 |
| 15 | 1.5 | Yes | 1:1 | 8 | 36.5 | (4)Additive 3 | 0.91% | 0 |
| 16 | 1.5 | Yes | 1:1 | 8 | 42.2 | (1)Additive 4 | 1.06% | 2 |
| 16B | 1.5 | Yes | 1:1 | 8 | 36 | (1)Additive 4 | 0.90% | 2.5 |
| 17 | 1.5 | Yes | 1:1 | 8 | 41.2 | (5)Additive 5 | 1.03% | 2 |
| 17B | 1.5 | Yes | 1:1 | 8 | 40 | (5)Additive 5 | 1.00% | 2.5 |
| 18 | 1.5 | Yes | 1:1 | 8 | 40.9 | (4)Additive 3 | 1.02% | 2 |
| 18B | 1.5 | Yes | 1:1 | 8 | 39.4 | (4)Additive 3 | 0.99% | 2.5 |

The terms identified by superscripts are defined as follows:

(1)"Additive 4" is a stearylated melamine/paraffin wax based aqueous composition obtained commercially from RohmNova under the tradename Sequapel ® 414.

(2)"Starch" is an ethylated starch obtained commercially from Penford under the tradename Penford 270.

(3)"Microspheres" is a expandable microsphere obtained commercially from Expancel Inc. under the tradename "Expancel".

(4)"Additive 3" is a styrene-butadiene copolymer based aqueous composition obtained commercially from Michelman under the tradename Vaporcoat 2200r.

(5)"Additive 5" is a poly(methylmethacrylate)/paraffin wax based aqueous composition obtained commercially from Spectra Kote under the tradename Spectra Guard 763 B.

(6)"Additive 6" is a styrene-acrylic acid copolymer based aqueous composition obtained commercially from Hercules under the tradename M 1322.

(7)"Additive 2" is a SBR (styrene-butadiene) based aqueous composition obtained commercially from Michelman under the tradename X300plus.

(8)"Additive 1" is an acrylic polymer based aqueous composition obtained from Progressive Coatings under the tradename Progressive J0819D.

(9)"Additive 9" is a styrene-maleic anhydride copolymer based aqueous composition obtained commercially from Hercules Incorporated under the tradename Scripset 745.

EXAMPLE IV

Using the procedures of Example II, the ability of the substrates of Example III to shed water was evaluated. The results are set forth in the following Table IV.

TABLE IV

| Expt No. | Cobb Size, Felt Side | Cobb Size, Wire Side | Watershedability |
|---|---|---|---|
| 1 | 41.6 | 43.5 | C |
| 1B | 47.4 | 49.3 | C |
| 2 | 46.9 | 48.5 | C |
| 3 | 35.7 | 33 | C |
| 4 | 30.8 | 31.6 | C |
| 4B | 29.9 | 29.8 | C |
| 4C | 30.8 | 31.6 | C |
| 5 | 30 | 26.8 | C |
| 5B | 28.6 | 29.1 | C |
| 6 | 27.7 | 27.1 | C |
| 6B | 23.4 | 25.7 | B |
| 9 | 30 | 30.1 | C |
| 9B | 24.8 | 24.9 | B |
| 10 | 25.2 | 19.6 | A |
| 10B | 22 | 25.3 | A |
| 11 | 24.5 | 22.8 | A |
| 11B | 23.6 | 21.4 | A |
| 12 | 31.7 | 31.8 | C |
| 12B | 31.7 | 31.2 | C |
| 12C | 31.6 | 32.3 | C |
| 13 | 25.1 | 26.7 | B |
| 13B | 25.5 | 25.8 | A |
| 13C | 24.2 | 25.1 | A |
| 14 | 26 | 27.8 | C |
| 15 | 27.8 | 32.7 | B |
| 16 | 18.4 | 21.1 | A |
| 16B | 18.5 | 20.2 | B |
| 17 | 24.1 | 26.5 | C |
| 17B | 17.7 | 20.7 | C |
| 18 | | | B |
| 18B | 22.6 | 23.2 | B |

What is claimed is:

1. A process of making a paper or paperboard, comprising contacting a paper or paperboard web comprising expandable microspheres at a size press with a composition comprising at least one hydrophobic polymer at an amount that is selected such that the paper or paper board exhibits a Cobb value that is equal to or less than 25.

2. The process according to claim 1, wherein the amount of said polymer is such that the Cobb Value is equal to or less than 23.

3. The process according to claim 1, wherein the amount of said polymer is such that the Cobb value is equal to or less than 21.

4. The process according to claim 1, wherein the amount of said polymer is such that the Cobb Value is equal to or less than 20.

5. The process according to claim 1, wherein the amount of said polymer is such that the paper or paperboard exhibits a contact angle equal to or greater than 128°.

6. The process according to claim 1, wherein the amount of said polymer is such that the paper or paperboard exhibits a contact angle equal to or greater than 130°.

7. The process according to claim 1, wherein the amount of said polymer is such that the paper or paperboard exhibits a contact angle equal to or greater than 132°.

8. The process according to claim 1, wherein the amount of said polymer is such that the paper or paperboard exhibits a contact angle equal to or greater than 133°.

9. The process according to claim 1, wherein the amount of said polymer is at least 0.4 wt % based on the dry weight of the paper or paperboard.

10. The process according to claim 1, wherein the amount of said polymer is at least 0.5 wt % based on the dry weight of the paper or paperboard.

11. The process according to claim 1, wherein the amount of said polymer is at least 0.9 wt % based on the dry weight of the paper or paperboard.

12. The process according to claim 1, wherein the amount of said polymer is from 1.3 to 3.0 wt % based on the dry weight of the paper or paperboard.

13. The process according to claim 1, wherein said composition comprises at least one sizing agent.

14. The process according to claim 13, wherein said at least one sizing agent comprises starch.

15. The process according to claim 14, wherein a weight ratio of starch to hydrophobic polymer picked up by the paper or paperboard web is less than 3 to 1.

16. The process according to claim 14, wherein a weight ratio of starch to hydrophobic polymer picked up by the paper or paperboard web is less than 2 to 1.

17. The process according to claim 14, wherein a weight ratio of starch to hydrophobic polymer picked up by the paper or paperboard web is less than 0.5 to 1.

18. The process according to claim 1, wherein the hydrophobic polymer is selected from the group consisting of a styrene acrylic emulsion, styrene acrylic acid, styrene maleic anhydride, alkylated melamine wherein the alkyl moiety is branched or linear and has at least 7 carbon atoms, paraffin wax, polyurethane, hydrophobically-modified starch, polyethylene, polymethylmethacrylate, alkyl ketene dimer, alkenyl ketene dimer, and rosin.

19. The process according to claim 1, wherein the hydrophobic polymer is selected from the group consisting of an alkylated melamine wherein the alkyl moiety is branched or linear and has at least 7 carbon atoms, and paraffin wax.

20. The process according to claim 1, wherein the hydrophobic polymer is a combination of one or more alkylated melamines wherein the alkyl moiety is branched or linear and has at least 7 carbon atoms and one or more paraffin waxes.

21. The process according to claim 1, wherein the hydrophobic polymer is a mixture of one or more alkylated melamine resins wherein the alkyl moiety is linear and has at least 13 carbon atoms and one or more paraffin waxes.

* * * * *